US010399202B2

(12) United States Patent
Hu et al.

(10) Patent No.: US 10,399,202 B2
(45) Date of Patent: Sep. 3, 2019

(54) RETAINING RING FOR LOWER WAFER DEFECTS

(71) Applicant: Applied Materials, Inc., Santa Clara, CA (US)

(72) Inventors: Yongqi Hu, Santa Clara, CA (US); Simon Yavelberg, Cupertino, CA (US); Gangadhar Sheelavant, Karnataka (IN); Kadthala R. Narendrnath, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 354 days.

(21) Appl. No.: 15/074,089

(22) Filed: Mar. 18, 2016

(65) Prior Publication Data

US 2016/0271750 A1 Sep. 22, 2016

Related U.S. Application Data

(60) Provisional application No. 62/135,677, filed on Mar. 19, 2015.

(51) Int. Cl.
*B24B 37/32* (2012.01)

(52) U.S. Cl.
CPC ..... *B24B 37/32* (2013.01)

(58) Field of Classification Search
CPC ..... B24B 37/32
USPC ..... 451/398
See application file for complete search history.

(56) References Cited

U.S. PATENT DOCUMENTS 6,224,472 B1 * 5/2001 Lai ..... B24B 37/32 451/288
6,699,107 B2 * 3/2004 Stoeckgen ..... B24B 37/32 451/289

FOREIGN PATENT DOCUMENTS

| | | | | |
|---|---|---|---|---|
| CN | 1890054 | A | | 1/2007 |
| CN | 2868552 | Y | | 2/2007 |
| CN | 205734411 | U | | 11/2016 |
| JP | 2008006526 | A | | 1/2008 |
| JP | 2009034745 | A | * | 2/2009 |
| KR | 20070011250 | A | | 1/2007 |

OTHER PUBLICATIONS

Office Action from Korean Patent Application No. 10-2016-0032084 dated Oct. 18, 2016.
Office Action from Japanese Patent Application No. 2016-056050 dated Mar. 22, 2017.
Office Action from Chinese Patent Application No. 201610151349.4 dated Nov. 30, 2018.

* cited by examiner

*Primary Examiner* — Joseph J Hail
*Assistant Examiner* — J Stephen Taylor
(74) *Attorney, Agent, or Firm* — Patterson + Sheridan, LLP

(57) ABSTRACT

A retaining ring and a chemical mechanical planarization system (CMP) are disclosed. In one embodiment, a retaining ring for a polishing system includes a ring-shaped body having a polished inner diameter. The body has a bottom surface having grooves formed therein, an outer diameter wall, and an inner diameter wall, wherein the inner diameter wall is polished to a roughness average ($R_a$) of less than about 30 microinches (μin).

8 Claims, 3 Drawing Sheets

RETAINING RING FOR LOWER WAFER DEFECTS

CROSS-REFERENCE TO RELATED APPLICATIONS

This application claims benefit of U.S. Provisional Application Ser. No. 62/135,677, filed Mar. 19, 2015, of which is incorporated by reference in its entirety.

FIELD

Embodiments of the invention relate to polishing systems for polishing a substrate, such as a semiconductor substrate. More particularly, embodiments relate to a retaining ring of the polishing system for polishing the substrate.

BACKGROUND

Chemical mechanical polishing (CMP) is one process commonly used in the manufacture of high-density integrated circuits to planarize or polish a layer of material deposited on a substrate. A carrier head may provide the substrate retained therein to a polishing station of a polishing system and controllably urge the substrate against a moving polishing pad. CMP is effectively employed by providing contact between a feature side of the substrate and moving the substrate relative to the polishing pad while in the presence of a polishing fluid. Material is removed from the feature side of the substrate that is in contact with the polishing surface through a combination of chemical and mechanical activity. Particles removed from a substrate while polishing become suspended in the polishing fluid. The suspended particles are removed while polishing the substrate by the polishing fluid.

As the feature size of the device patterns get smaller, the critical dimension (CD) requirement of features becomes a more important criterion for stable and repeatable device performance. When the CD of features shrink to sizes less than 20 nm, submicron scratches become more and more critical for device yield improvement. The CMP has a carrier head which typically includes a retaining ring that circumscribes the substrate and facilitates holding the substrate in the carrier head. During polishing, the substrate may come into contact with the retaining ring and break free portions of the retaining ring as well as adhered materials and introduce loose materials into the polishing process. These loose materials may come into contact with the substrate and polishing surface during polishing and contribute to microscratches (<100 nm) on the substrate as well as other types of defects such as line distortion and check mark defect.

Therefore, there is a need for an improved retaining ring.

SUMMARY

A retaining ring and a chemical mechanical polishing (CMP) system for polishing a substrate are disclosed. In one embodiment, a retaining ring for a CMP system includes a ring-shaped body having a polished inner diameter. The body has a bottom surface having grooves formed therein, an outer diameter wall, and an inner diameter wall, wherein the inner diameter wall is polished to a roughness average ($R_a$) of less than about 30 microinches (μin).

In another embodiment, a CMP system is provided that includes a rotatable platen configured to support a polishing pad, a polishing head configured to urge a substrate against the polishing pad during polishing, and a retaining ring coupled to the polishing head. The retaining ring includes a ring-shaped body having a polished inner diameter. The body has a bottom surface having grooves formed therein, an outer diameter wall, and an inner diameter wall, wherein the inner diameter wall is polished to a roughness average ($R_a$) of less than about 30 microinches (μin).

BRIEF DESCRIPTION OF THE DRAWINGS

So that the manner in which the above-recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

A retaining ring, chemical mechanical planarization system (CMP) and method for polishing a substrate are described herein. The retaining ring includes a polished inside diameter which have improved slurry release capabilities compared to conventional retaining rings without introducing significant fabrication costs or creating process variations during the consumption of the retaining ring during polishing of the substrate. The polished inside diameter substantially prevents adherence and subsequent agglomeration of slurry and polishing byproducts which could later break free and become a defect source while polishing a substrate. Thus, the reduction of material buildup minimizes the introduction of defects into the polished surfaces to improve production yields. Additionally, the reduction of material buildup increases production up-time and extends the interval between needed for preventative maintenance and cleaning of the carrier head.

Figure 1:
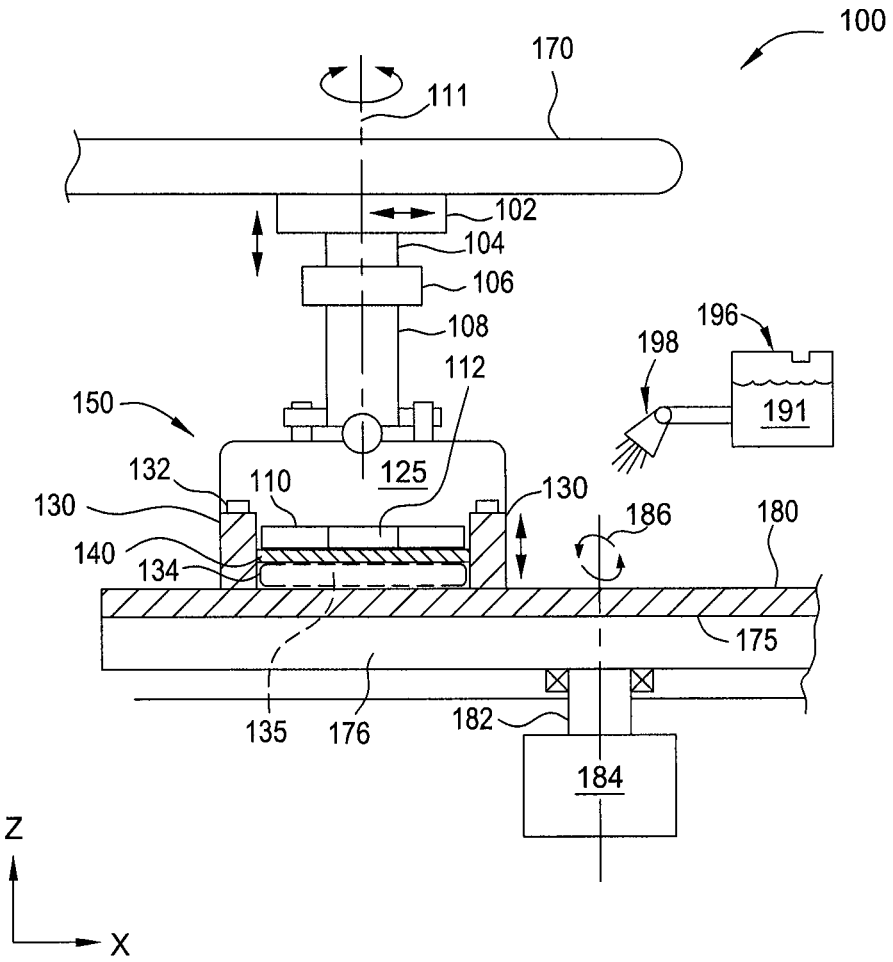
FIG. 1 is a partial cross-sectional view of a polishing apparatus having a carrier head that includes a retaining ring, according to one embodiment.

FIG. 1 is a partial cross-sectional view of a polishing apparatus 100 according to one embodiment. A carrier head 150 has a retaining ring 130 having a polished inside diameter which contributes to defect reduction as further described below. The carrier head 150 holds a substrate 135 (shown in phantom) in contact with a polishing surface 180 of a polishing pad 175. The polishing pad 175 is deposed on a platen 176. The platen 176 is coupled to a motor 184 by a platen shaft 182. The motor 184 rotates the platen 176 and hence, polishing surface 180 of the polishing pad 175, about an axis 186 of the platen shaft 182 when the polishing apparatus 100 is polishing the substrate 135.

The polishing apparatus 100 may include a chemical delivery system 190. The chemical delivery system 190 includes a chemical tank 196 which holds polishing fluid 191, such as a slurry or deionized water. The polishing fluid 191 may be sprayed by a spray nozzle 198 onto the polishing surface 180 which rotates the polishing fluid 191 into contact with the substrate 135 pressed by the carrier head 150 against the polishing surface 180 in order to planarized the substrate 135 and remove adhered defects, (e.g. particles), and other polishing residue.

The carrier head 150 is coupled to a shaft 108, which is coupled to a motor 102, which is in turn coupled to an arm 170. The motor 102 moves the carrier head 150 laterally in a linear motion (X and/or Y direction) relative to the arm 170. The carrier head 150 also includes an actuator or motor 104 to move the carrier head 150 in the Z direction relative to arm 170 and/or the polishing pad 175. The carrier head 150 is also coupled to a rotary actuator or motor 106 that rotates the carrier head 150 about a rotational axis 111 relative to the arm 170. The motors 104, 102, and 106 position and/or move the carrier head 150 relative to the polishing surface 180 of the polishing pad 175. In one embodiment, the motors 104, 102, and 106 rotate the carrier head 150 relative to the polishing surface 180 and provide a down-force to urge the substrate 135 against the polishing surface 180 of the polishing pad 175 during processing.

The carrier head 150 includes a body 125 circumscribed by the retaining ring 130. The retaining ring 130 has an inner ring diameter 134. The inner ring diameter 134 may be configured to receive a semiconductor substrate having a diameter of 200 mm, 300 mm, 450 mm or other production semiconductor substrate diameter. The inner ring diameter 134 may have a diameter of about 5 mm than the substrate 135 disposed therein. For example, the inner ring diameter 134 may have a diameter of about 455 mm to accept a 450 mm substrate 135. Alternately, the inner ring diameter 134 may have a diameter of about 305 mm to accept a 300 mm substrate 135. The retaining ring 130 may also have a plurality of slurry grooves 268 (illustrated in FIG. 2). The carrier head 150 may also contain one or more bladders 110/112 that are adjacent to a flexible membrane 140. The flexible membrane 140 contacts a backside of the substrate 135 when the substrate 135 is retained in the carrier head 150.

In one embodiment, the retaining ring 130 is coupled to the body 125 by an actuator 132. In one aspect, pressure is applied to the retaining ring 130 to urge the retaining ring 130 toward the polishing surface 180 of the polishing pad 175 during a polishing process. The motor 106 rotates the carrier head 150 about a rotational axis 111 and thus the substrate 135 supported therein while polishing is substantially rotated about the rotational axis 111. The inner ring diameter 134 of the retaining ring 130 is sized to support the substrate 135 therein. While rotating the substrate 135 in the carrier head 150, the substrate 135 may bump or strike the inner ring diameter 134 of the retaining ring 130. The chemical delivery system 190 delivers the polishing fluid 191 to the polishing surface 180 and substrate 135 during polishing. The slurry grooves of the retaining ring 130 facilitate transportation of the polishing fluid 191 and entrained polishing debris through the retaining ring 130 and away from the substrate 135. The inner ring diameter 134 of the retaining ring 130 is constructed in a manner to prevent excess entrained polishing fluid from adhering thereto, and thus, mitigate damage to the retaining ring 130 from the substrate 135 held therein while also reducing the amount of particles released in response to contact between the ring 130 and substrate 135 while polishing.

Figure 2:
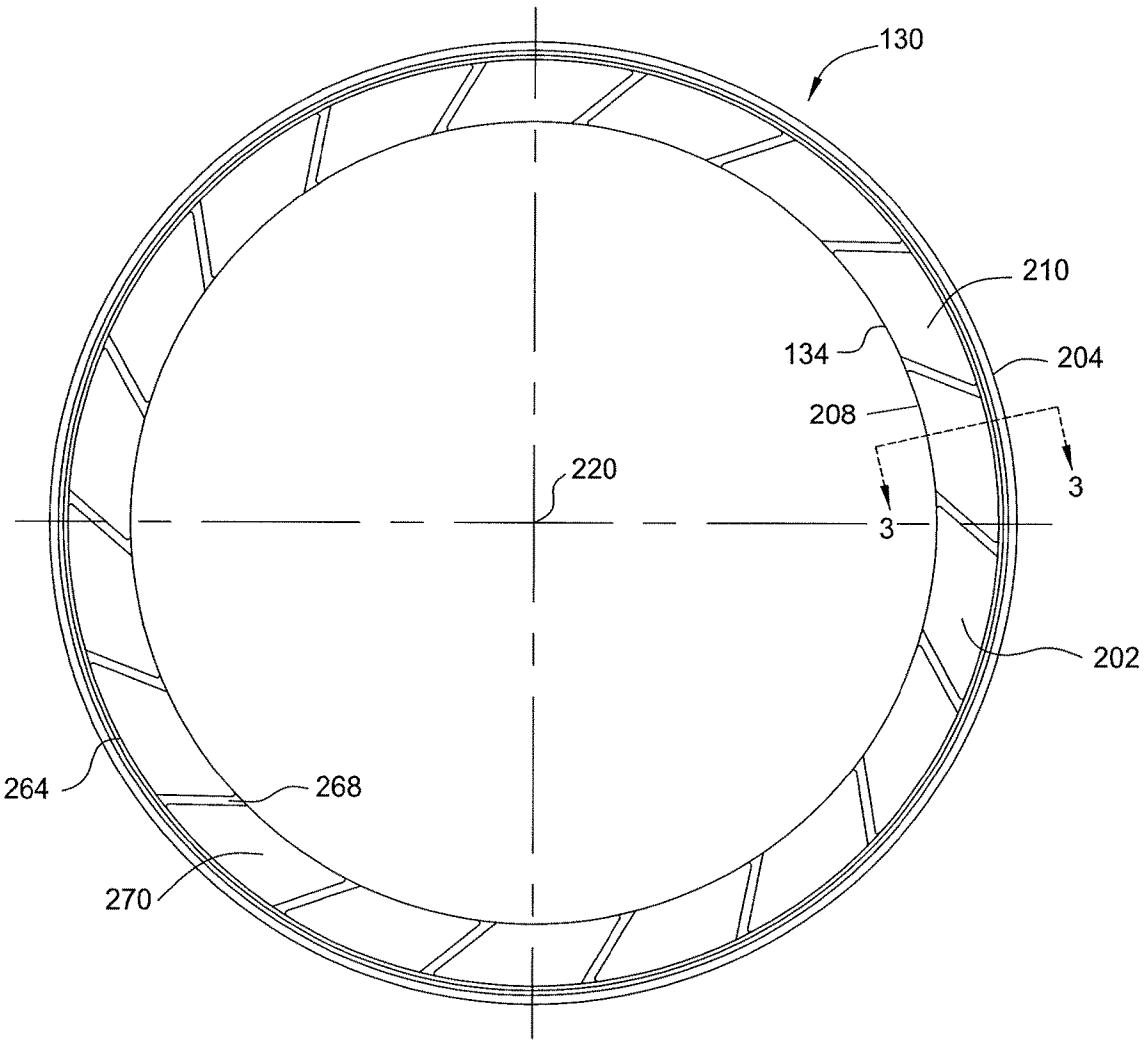
FIG. 2 is a bottom plan view of a retaining ring, according to one embodiment.

FIG. 2 is a bottom plan view of the retaining ring 130. The retaining ring 130 may consist of body 202 formed from a single mass of material. Alternately, the body 202 may be formed from one of more portions, such as an upper portion 320 (shown in FIG. 3) configured to mount the body 202 to the carrier head 150 and a lower portion 210 configured to contact the polishing pad 175 and substrate 135. The portions of the body 202 may include multiple pieces which fit together to form the shape of body 202. In one embodiment, the body 202 of the retaining ring 130 is of a single unitary construction. In another embodiment, the body 202 of the retaining ring 130 has two portions, the upper portion 320 and lower portion 210.

The body 202 may be formed from stainless steel, aluminum, molybdenum, or another process-resistant metal or alloy, or a ceramic or a ceramic filled polymer or other suitable material. In one embodiment, at least the upper portion 320 of the body 202 is fabricated from one or more of a process-resistant metal or alloy, such as stainless steel, aluminum, and molybdenum, ceramic or ceramic filled polymer. Additionally, the body 202 may be fabricated from a plastic material such as polyphenylene sulfide (PPS), polyethylene terephthalate, polyetheretherketone, polybutylene terephthalate, Ertalyte TX, PEEK, Torlon, Delrin, PET, Vespel, Duratrol, or other suitable material. In one embodiment, at least the lower portion 210 of the body 202 in which the grooves 268 are formed is fabricated from a plastic material. In another embodiment, the lower portion 210 may be fabricated from a metal material.

The body 202 may be ring shaped, having a center 220. The body 202 may also include a bottom surface 270, an inner diameter wall 208 and an outer diameter wall 264. The inner diameter wall 208 defines the inner ring diameter 134 of the retaining ring 130 and has an inner radius sized to accept the substrate 135.

The body 202 of the retaining ring 130 may also include a process-resistant coating which may cover one or more surfaces of the retaining ring 130 that are exposed to process conditions and/or prone to release of metals and/or accumulated process materials. The process-resistant coating may be a hydrophobic material that resists chemical interaction with process fluids, such as a polymeric material selected based on the chemistry of the polishing fluid used to process the substrate 135 in the polishing apparatus 100. The polymeric material may be a carbon-containing material such as parylene (polyparaxylylene), for example Parylene C (chlorinated linear polyparaxylylene), Parylene N (linear polyparaxylylene), and Parylene X (cross-linked polyparaxylylene). Other carbon-containing materials that may be used include polyetheretherketones (PEEK), polyphenylene sulfide (PPS), polyethylene terephthalate (ERTALYTE® TX (ETX)), chemical mechanical polishing long life x5 (CMP LL5) polyester, amorphous transparent polyetherimide (ULTEM™ 1000), polyethylene terephthalate (PET), and diamond-like carbon (DLC).

A plurality of grooves 268 may be formed in the lower portion 210 of the retaining ring 130. The grooves 268 extend from the inner ring diameter 134 to an outer diameter wall 264 of the lower portion 210. The grooves 268 may have sufficient depth to permit fluids, such as slurry material and suspended solids, to move through the groove 268 from the inner ring diameter 134 to the outer diameter wall 264. The number and configuration of the grooves 268 may be configurable and/or dependent on process conditions. For example, the retaining ring 130 may have 18 equally spaced grooves 268 to permit fluid move out from under and away from the substrate 135 as the carrier head 150 and retaining ring 130 are rotated. The fluid transport slurry and other loose material through the groove 268 away from the substrate 135 to mitigate scratching or damaging the surface of the substrate 135 while the substrate is undergoing a polishing operation.

Figure 3:
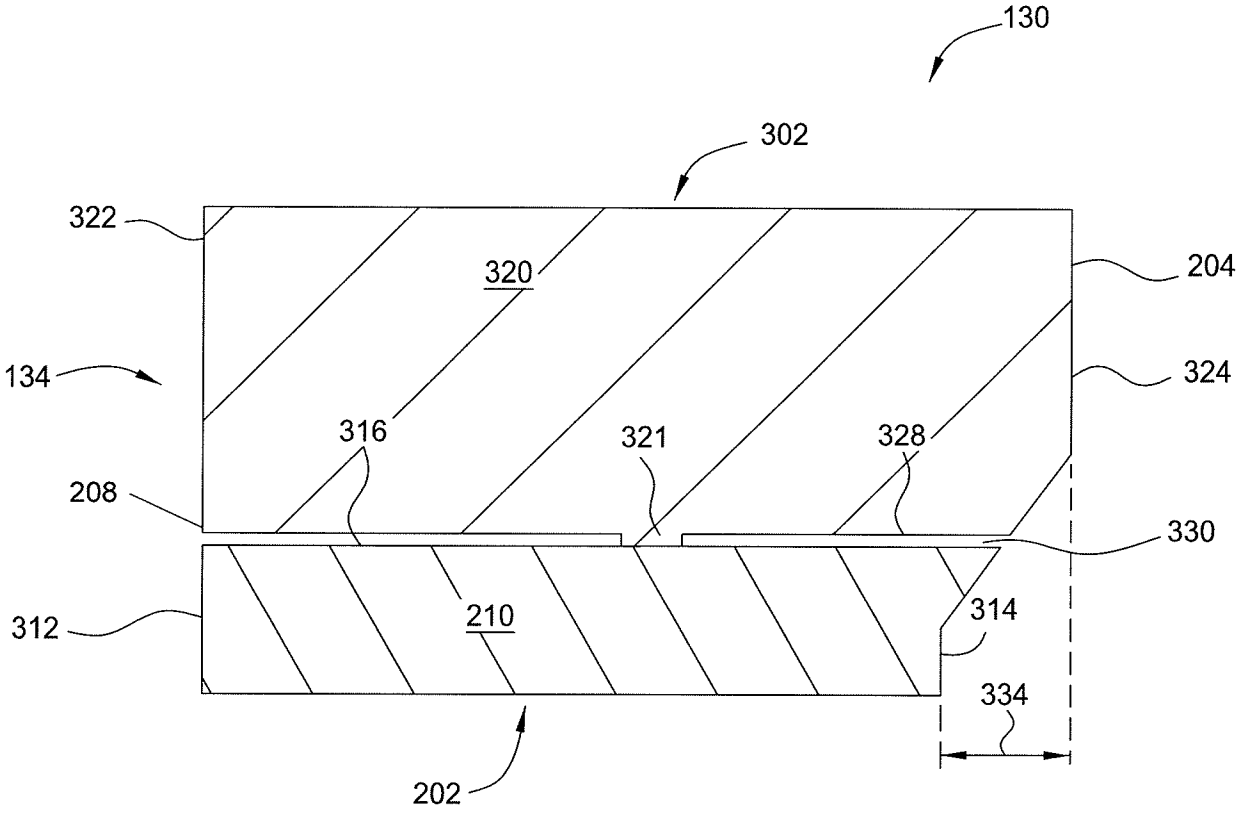
FIG. 3 is a cross-sectional view for a portion of the retaining ring taken along a section line 3-3 of FIG. 2.

FIG. 3 is a cross-sectional view for a portion of the retaining ring 130 taken along section line 3-3 of FIG. 2. The upper portion 320 of the retaining ring 130 may be coupled concentrically to the lower portion 210 of the retaining ring 130. The upper portion 320 and the lower portion 210 of the body 202 may fit together and be joined at an interface 330 by an adhesive material, such as an epoxy material, a urethane material, or an acrylic material. The upper portion 320 may have a spacer 321 along its bottom surface 328. The spacer 321 is provided between the bottom surface 328 of the upper portion 320 and a top surface 316 of the lower portion 210 of assembly for the retaining ring 130. The spacer 321 provides a uniform gap that minimizes the adhesive material from being squeezed out or unevenly filled between the bottom surface 328 of the upper portion 320 and top surface 316 of the lower portion 210, while enhancing dimensional repeatability between rings 130.

The upper portion 320 has an inner diameter wall 322. The lower portion 210 has an inner diameter wall 312. The inner diameter walls 322, 312 for each of the upper and lower portions 320, 210 are coincident with the inner ring diameter 134 of the ring assembly. The inner diameter walls 322, 312 for both the upper portion 320 and the lower portion 210 are polished. The inner diameter walls 322, 312 may be polished by lapping, CMP, flame polishing, vapor polishing or by other suitable method. The inner diameter wall 322, 312 may be polished to have a roughness average ($R_a$) in microinches (μin) of less than about 30 $R_a$, such as between about 2 $R_a$ and about 10 $R_a$, or about 4 $R_a$.

In one embodiment, the retaining ring 130 is formed from a single piece of material and the inner ring diameter 134 may be polished to an $R_a$ of less than 10 μin. The inner ring diameter 134 has a polished/smoothed surface which improves the inner ring diameter 134 groove wear as well as significantly reducing particle generation. Polishing the inner ring diameter 134 results in less grooving and wear from contact with the substrate, and additionally results in less the particle generation and byproduct attachment. Additionally, polishing the inner ring diameter 134 provides easy cleaning and prevents the slurry and other materials from adhering to the inner ring diameter 134. Thus, polishing the surface of the inner ring diameter 134 minimizes particles from entering the polishing operation of a substrate 135 and scratching/damaging the surface of the substrate 135.

In another embodiment, the lower portion 210 of the retaining ring 130 has the inner diameter wall 312 polished to a between about 8 Ra and about 10 Ra to reduce the friction on the retaining ring 130 on collision with the substrate 135 while the substrate 135 is being polished on a CMP. The reduced friction of the inner diameter wall 312 reduces particle generation from the collision as well as slurry material from adhering to the inner diameter wall 312 of the retaining ring 130.

In another embodiment, the inner diameter wall 322 of the upper portion 320 is polished to between about 10 $R_a$ and about 15 $R_a$. In yet another embodiment, the inner diameter wall 322 of the upper portion 320 is polished to about 2 $R_a$ or less. Polishing of the inner diameter wall 322 prevents the slurry and other materials from adhering to the inner diameter wall 322 of the retaining ring 130 where they may agglomerate and later become dislodged, becoming a contamination and potential scratching source. Thus, reducing particle/byproduct accumulation on the inner diameter wall 322 of the retaining ring 130 contributes to the reduction of defects on polished substrates 135. Additionally, the polished inner diameter wall 322 cleans more readily as the slurry and other materials substantially do not adhere to the polished surface.

The upper portion 320 has an outside diameter wall 324 coincident with the overall outside diameter wall 204 of the retaining ring 130. The lower portion 210 has an outside diameter wall 314 which is concentric with the overall outside diameter wall 204 of the retaining ring 130. The outside diameter wall 314 of the lower portion 210 may have some dimension 334 smaller than the overall outside diameter wall 204 for the retaining ring 130. The outside diameter walls 324, 314 may be polished to a roughness average ($R_a$) in μin of less than about 30 $R_a$, such as between about 2 μin and about 10 $R_a$, or about 4 $R_a$. The polished surface reduces the adherence of the slurry and other materials to the outside diameter walls 324, 314 of the retaining ring 130 and facilitates the cleaning of the material from the exterior of the retaining ring 130. The outside diameter walls 324, 314 of the retaining ring 130 thus inhibits accumulation of slurry and polishing byproducts, thus reducing the potential for micro-scratches in the surface of the substrate 135 while undergoing CMP.

While the foregoing is directed to embodiments of the invention, other and further embodiments of the invention may be devised without departing from the basic scope thereof.

What is claimed is:

1. A retaining ring for a polishing system, the retaining ring comprising:
- a ring-shaped body having:
  - an upper portion comprising:
    - a bottom surface having a tab extending therefrom;
    - an upper inner diameter wall having an inside diameter suitable to accommodate a semiconductor substrate therein, wherein the upper inner diameter wall is polished to a upper wall roughness average (Ra) of about 4 microinches (μin);
    - a polished upper outer diameter wall;
  - a lower portion concentric with the upper portion, the lower portion comprising:
    - a bottom surface having grooves formed therein,
    - a lower outer diameter wall wherein the polished upper outer diameter wall has a diameter greater than a diameter of the lower outer diameter wall; and
    - a lower inner diameter wall having a diameter selected to accommodate a semiconductor substrate, wherein the lower inner diameter wall is polished to a lower wall roughness average (Ra) of about 2 microinches (μin) wherein the upper wall roughness average is greater than the lower wall roughness average.

2. The retaining ring of claim 1, wherein the upper portion is comprised of a metal and the lower portion is comprised of a plastic.

3. The retaining ring of claim 1, wherein the inner diameter wall is configured to receive a semiconductor substrate having a diameter of 200 mm, 300 mm or 450 mm.

4. The retaining ring of claim 1, wherein the outer diameter is polished to a roughness averaged of less than about 30 μin.

5. A CMP system comprising:
- a rotatable platen configured to support a polishing pad;
- a polishing head configured to urge a substrate against the polishing pad during polishing; and
- a retaining ring comprising:

an upper portion comprising:

a bottom surface having a tab extending therefrom;

an upper inner diameter wall having an inside diameter suitable to accommodate a semiconductor substrate therein, wherein the upper inner diameter wall is polished to a upper wall roughness average (Ra) of about 4 microinches (μin);

a polished upper outer diameter wall;

a lower portion concentric with the upper portion, the lower portion comprising:

a bottom surface having grooves formed therein, a lower outer diameter wall wherein the polished upper outer diameter wall has a diameter greater than a diameter of the lower outer diameter wall; and a lower inner diameter wall having a diameter selected to accommodate a semiconductor substrate, wherein the lower inner diameter wall is polished to a lower wall roughness average (Ra) of about 2 microinches (μin) wherein the upper wall roughness average is greater than the lower wall roughness average.

6. The CMP system of claim 5, wherein the upper portion is comprised of a metal and the lower portion is comprised of a plastic.

7. The CMP system of claim 5, wherein the inner diameter wall is configured to receive a semiconductor substrate having a diameter of 200 mm, 300 mm or 450 mm.

8. The CMP system of claim 5, wherein the outer diameter is polished to a roughness averaged of less than about 30 μin.

* * * * *